US005754935A

United States Patent [19]

Kubo et al.

[11] Patent Number: 5,754,935

[45] Date of Patent: May 19, 1998

[54] VANE MATERIAL AND PROCESS FOR PREPARING SAME

[75] Inventors: Yutaka Kubo; Hideki Nakamura; Norimasa Uchida, all of Tottori; Keiji Yamasaki, Shimane, all of Japan

[73] Assignee: Hitachi Metals, Ltd., Tokyo, Japan

[21] Appl. No.: 258,665

[22] Filed: Jun. 10, 1994

[30] Foreign Application Priority Data

Jun. 11, 1993 [JP] Japan ..... 5-140437

[51] Int. Cl.[6] ..... B22F 3/12; B22F 5/04; C22B 33/02; C22C 38/00

[52] U.S. Cl. ..... 419/10; 419/13; 419/14; 419/16; 419/17; 419/18; 419/38; 75/236; 75/238; 75/239; 75/241; 75/242; 75/244; 75/246

[58] Field of Search ..... 419/10, 13, 14, 419/16, 17, 18, 38; 75/236, 238, 239, 241, 242, 244, 246

[56] References Cited

U.S. PATENT DOCUMENTS

| | | | |
|---|---|---|---|
| 4,880,461 | 11/1989 | Uchida | 75/238 |
| 4,885,132 | 12/1989 | Brandt et al. | 419/15 |
| 4,944,800 | 7/1990 | Kolaska et al. | 75/238 |
| 4,957,548 | 9/1990 | Shima et al. | 75/238 |
| 4,973,355 | 11/1990 | Takahashi et al. | 75/233 |
| 4,983,212 | 1/1991 | Iyori et al. | 75/238 |
| 5,145,585 | 9/1992 | Saito et al. | 75/238 |
| 5,462,901 | 10/1995 | Egami et al. | 501/87 |
| 5,466,276 | 11/1995 | Sato et al. | 75/237 |

FOREIGN PATENT DOCUMENTS

| | | | |
|---|---|---|---|
| 59660 | 1/1993 | Japan | C22C 38/00 |
| 59661 | 1/1993 | Japan | C22C 38/00 |

*Primary Examiner*—Charles T. Jordan
*Assistant Examiner*—Daniel Jenkins
*Attorney, Agent, or Firm*—Sughrue, Mion, Zinn, Macpeak & Seas

[57] ABSTRACT

The present invention provides a vane material having an excellent scuffing resistance in a compressor employing an alternative Freon gas as a cooling medium and a process for the preparation thereof. In accordance with the present invention, a vane material is provided having a structure comprising a base material consisting essentially of 1.0 to 4.5% by weight of carbon, not more than 1.5% by weight of silicon, not more than 1.0% by weight of manganese, 3 to 6% by weight of chromium, not more than 30% of tungsten and/or not more than 20% by weight of molybdenum provided that (W+2Mo) is not more than 45% by weight, 2 to 10% by weight of vanadium and/or niobium, not more than 20% by weight of cobalt, and a balance of iron and inavoidable impurities with additive particles of a carbide and additive particles of a nitride and/or a carbonitride, sintered thereto in an amount of more than 0% to not more than 25% by weight and 2 to 25% by weight based on the total weight of the vane material, respectively. The vane material according to the present invention can be obtained by sintering the mixture of the base powder with the particulate carbide and nitride or carbonitride powders.

6 Claims, 1 Drawing Sheet

VANE MATERIAL AND PROCESS FOR PREPARING SAME

FIELD OF THE INVENTION

The present invention relates to a material for vane in compressors such as rotary compressor and vane pump and a process for preparing the same.

BACKGROUND OF THE INVENTION

As shown in FIG. 1, a known compressor using a vane comprises a vane 1 which is always pressed against a rotor 2 by means of a spring 4. As the rotor 2 rotates eccentrically, the vane 1 reciprocates to make a change in the volume of the space formed by the rotor 2 and a cylinder 3 so that a gas therein is compressed. As a gas which serves as a cooling medium there has heretofore been used a Freon gas.

As shown in FIG. 1, the tip and the side faces of the vane come into sliding contact with the rotor and the cylinder, respectively. Thus, the vane must resist abrasion with the rotor or cylinder as well as must not abrade the rotor or the cylinder.

As the vane material there has heretofore been normally used high-speed steel made by melting and casting according to JIS SKH51. Such a material has been occasionally subjected to surface treatment such as oxidation-nitriding. Further, for the purpose of improving the quality or composition of vane, the abrasion resistance of vane or the self-lubrication of vane, some approaches have been proposed as disclosed in JP-A-56-47550 (The term "JP-A" as used herein means an "unexamined published Japanese patent application"), JP-A-59-20446, JP-A-61-48556, JP-A-64-35091, and JP-A-2-102392.

As a cooling medium to be compressed in the compressor there has been heretofore used a chlorofluorocarbonic (hereinafter referred to as CFC") Freon gas. However, CFC reaches to the stratosphere where it is then decomposed by ultraviolet rays to release chlorine which destroys the ozone layer. Therefore, a plan was made to abolish CFC until 2,000, and the development of substitutes of cooling media is in progress. As the most favorable substitutes of cooling medium there has been proposed a chlorine-free Freon gas such as hydrofluorocarbon (hereinafter referred to as "HFC"). This kind of a Freon gas causes little environmental pollution. However, as compared with vane pumps or rotary compressors employing conventional CFC Freon gas, those employing HFC Freon gas have been known to have the following problems:

i. The lubricating ability of the cooling medium deteriorates.

ii. These machines need to be operated at a high compression ratio so that the load added on the vane is increased.

iii. The cooling medium has a high moisture absorption.

iv. The lubricating ability of the lubricant used deteriorates.

v. The moisture absorption of the lubricant increases.

vi. In the case of CFC Freon gas, the chlorine-containing molecule serve as an extreme pressure agent. However, HFC Freon gas is free of chlorine and thus can cause the vane and rotor to wear or cause so-called scuffing, i.e., seizuring mark.

These defects cause extreme acceleration of sliding abrasion of the conventional vane with the rotor. The extreme case is that the vane bites or scores the rotor. It has thus been found that the foregoing defects shorten the practical life of the compressor.

The inventors have proposed as a vane material for compressors employing HFC Freon gas a material comprising a base material consisting of 1.0 to 3.5% by weight of carbon, not more than 1.5% by weight of silicon, not more than 1.0% by weight of manganese, 3 to 6% by weight of chromium, not more than 30% of tungsten and/or not more than 20% by weight of molybdenum provided that (W+2Mo) is from 24 to 40% by weight, not more than 5% by weight of vanadium and/or niobium, not more than 20% by weight of cobalt, and a balance of iron and inavoidable impurities with one or more kinds of nitride and carbonitride grains dispersed therein in a total amount of 2 to 20% by weight based on the weight of vane in JP-A-5-9660.

Further, JP-A-5-9661 proposes a vane material comprising a base material consisting of 1.0 to 3.5% by weight of carbon, not more than 1.5% by weight of silicon, not more than 1.0% by weight of manganese, 3 to 6% by weight of chromium, not more than 20% of tungsten and/or not more than 10% by weight of molybdenum provided that (W+2Mo) is not more than 23% by weight, not more than 12% by weight of vanadium and/or niobium, not more than 20% by weight of cobalt, and a balance of iron and inavoidable impurities with one or more kinds of nitride and carbonitride particle dispersed therein in a total amount of 2 to 20% by weight based on the weight of vane.

The vane described in the above cited JP-A-5-9660 and JP-A-5-9661 is advantageous in that the nitride or carbonitride particle exhibits a low affinity for iron and hence a low friction coefficient, enabling the reduction of abrasion of the vane and the rotor and the cylinder.

As mentioned above, however, the vane as described in the above cited Japanese patent applications causes troubles such as damage on the rotor and other members in an atmosphere of HFC Freon gas. Thus, a vane which is more resistant to scuffing (i.e., seizuring resistance) has been desired. The foregoing vane material leaves something to be desired in this respect.

The inventors have made studies on the abrasion resistance of the foregoing vane material. As a result, it was found that the nitride or carbonitride is effective for the reduction of friction coefficient but the scuffing resistance is still insufficient.

SUMMARY OF THE INVENTION

An object of the present invention is to provide a vane material having an excellent scuffing resistance and a process for preparing the same.

The inventors studied the addition of carbide particles to a vane material containing either nitride particles or carbonitride particles. As a result, it was found that the carbide can exert an extremely excellent effect of enhancing the scuffing resistance. Thus, the present invention has been worked out.

The present invention provides a vane material having a structure which is obtained by sintering a composition comprising a base material consisting essentially of 1.0 to 4.5% by weight of carbon, not more than 1.5% by weight of silicon, not more than 1.0% by weight of manganese, 3 to 6% by weight of chromium, not more than 30% of tungsten and/or not more than 20% by weight of molybdenum provided that (W+2Mo) is not more than 45% by weight, 2 to 10% by weight of vanadium and/or niobium, not more than 20% by weight of cobalt, and a balance of iron and inavoidable impurities with additive particles of a carbide and additive particles of a nitride and/or a carbonitride, sintered thereto in an amount of more than 0% to not more than 25% by weight and 2 to 25% by weight based on the total weight of the composition, respectively.

BRIEF DESCRIPTION OF THE DRAWING

By way of example and to make the description more clear, reference is made to the accompanying drawings in which.

DETAILED DESCRIPTION OF THE INVENTION

Figure 1:
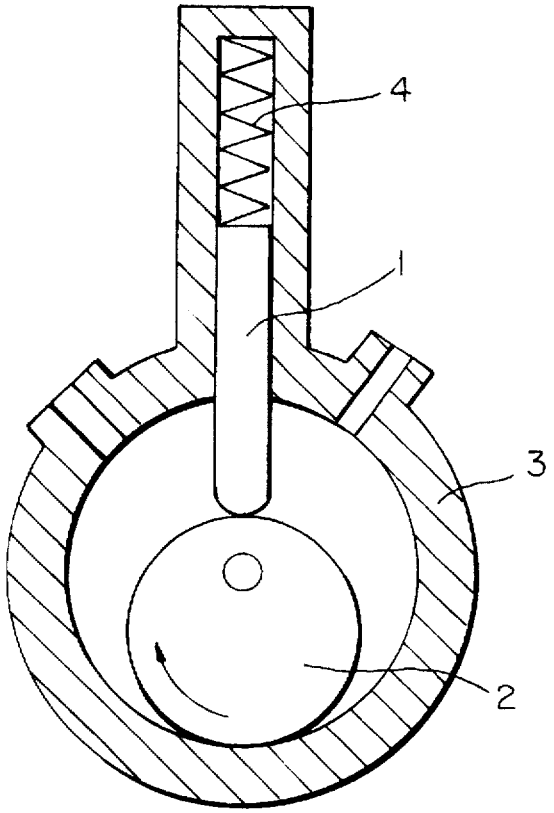
FIG. 1 is a sectional view illustrating an example of rotary compressors wherein the numerals 1, 2, 3, and 4 indicate vane, rotor, cylinder and spring, respectively.

The vane material according to the present invention can be obtained by the preparation method according to the present invention which comprises mixing a base powder having the foregoing composition with a carbide powder and a nitride and/or carbonitride powder, in an amount of more than 0% to not more than 25% by weight and 2 to 25% by weight based on the total weight of vane material, respectively, and then sintering the obtained mixture.

As the foregoing additive carbide there may be used a carbide of the group 4A or 5A element. The additive carbide which can provide for improving abrasion resistance is an MC type carbide (e.g., a carbide of Zr, Ti, Hf, V, Nb and Ta) rather than one which may react with the base material to form an $M_6C$ type carbide (e.g., a carbide of W and Mo). In particular, vanadium carbides and niobium carbides are superior to carbides of other elements because they can be homogeneously and finely dispersed in the base material.

In the present invention, additive particles selected from the group consisting of nitride particles and carbonitride particles of elements (Ti, Zr, Hf, V, Nb, Ta) as basic dispersed particles for reducing the friction coefficient are particularly stable. Thus, these grains can hardly be solid-solutioned in the base material and can be homogeneously dispersed therein.

As mentioned above, one of the greatest features of the present invention is that an additive carbide is sintered so that it is dispersed in the base material to improve the scuffing resistance.

In detail, an acceleration test for evaluating the scuffing resistance shows that the composite addition of a carbide particle to a nitride or carbonitride particle can drastically raise the maximum allowable load under which the vane material has no scuffing with the rotor or the cylinder as compared with addition of the nitride or carbonitride free of the addition of the carbide. That is, the composite addition of the carbide particle to a nitride or carbonitride particle can prevent generation of seizuring (mark).

In the present invention, the additive carbide particle is dispersed in the base material by sintering. The presence of a lot of carbides in the vane material can be accomplished by increasing the content of elements to be carbonized in the base material. However, this method is undesirable because these elements to be carbonized such as vanadium and niobium can be easily oxidized to oxidize a base powder, deteriorating the sinterability thereof.

Further, the excessive increase in the content of vanadium, niobium, etc. in the base raises the viscosity of the molten metal, making it impossible to be atomized into a base powder. Therefore, it is preferred that a carbide is added as carbide powder and then mixed with base powder.

If the amount of the carbide to be added exceeds 25% by weight based on the total weight of the vane material (i.e., the composition of the vane material), it causes a deterioration of toughness. Thus, it should be more than 0% to not more than 25% by weight based on the total weight of the vane material. In order to further improve the scuffing resistance as well as the sinterability of the base material, the amount of the carbide to be added is preferably in the range of 1 to 20% by weight, more preferably 2 to 15% by weight based on the total weight of the vane material.

In the present invention, the nitride and/or carbonitride are essential because they reduce the friction coefficient.

A vane slides on a rotor or a cylinder to operate the compressor. Accordingly, even though the vane alone has a high abrasion resistance, if mating member such as cylinder and rotor undergoes an abnormal abrasion, sufficient air-tightness cannot be maintained, lowering the performance of the compressor. A rotor and a cylinder are normally made of cast iron. Accordingly, if a nitride or carbonitride particle having a low affinity for iron is dispersed in a base material having the foregoing steel composition, it provides a drastic reduction of friction coefficient that will eliminate scoring with the rotor or the cylinder.

This effect not only prevents the vane from wearing itself but also drastically reduces the abrasion of the vane with the rotor and the cylinder.

If the amount of the nitride and carbonitride to be added decreases less than 2% by weight based on the total weight of the vane material, this effect is not sufficient. On the contrary, if it exceeds 25% by weight based on the total weight of the vane material, it lowers the sinterability of the base material, making it impossible to mass produce a vane with a stable quality. Therefore, it is necessary that the amount of a nitride and/or a carbonitride to be added be in the range of 2 to 25% by weight.

As such a nitride and/or carbonitride there may be preferably selected from the group consisting of nitrides and carbonitrides of Ti, Zr, Hf, V, Nb and Ta as mentioned above. As other nitrides or carbonitrides also have a low affinity for iron, they are useful.

The reason for the restriction of alloy components to be incorporated in the base material of the vane material of the present invention will be described hereinafter.

Carbon is bonded to tungsten, molybdenum, vanadium, etc. added at the same time to form a hard carbide, so that exerts an effect of enhancing the abrasion resistance of the vane material and hence eliminating scoring with its mating members. Carbon is partially solid-solutioned in the base material to raise the hardness of the vane material and hence improve the abrasion resistance of the vane material. Accordingly, there is an optimum content of carbon depending on the amount of elements to be carbonized such as tungsten, molybdenum and vanadium. In the present invention, if the content of carbon decreases less than 1.0% by weight, it cannot provide the vane material with a sufficient hardness and the amount of a carbide formed is too small. On the contrary, if the content of carbon exceeds 4.5% by weight, it lowers the toughness of the vane material. Accordingly, the content of carbon should be in the range of 1.0 to 4.5% by weight.

Silicon is a deoxidizing element that has an effect of enhancing the hardness of the vane material. Silicon is also solid-solutioned in the base material to exert an effect of enhancing the hardness of the vane material. If the content of silicon exceeds 1.5% by weight, it lowers the toughness of the vane material. Accordingly, the content of silicon should be not more than 1.5% by weight.

Manganese also is a deoxidizing element that has an effect of improving the hardness of the vane material. Accordingly, the content of manganese should be not more than 1.0% by weight.

Chromium forms a carbide to exert an effect of enhancing the abrasion resistance of the vane material. Chromium is also solid-solutioned in the base material to impart hardenability to the base material and improve the corrosion resistance thereof. In the present invention, since HFC to be used as substitutes of the Freon gas (CFC) has a high moisture absorption and the lubricant used is decomposed to form a carboxylic acid such as formic acid and acetic acid, the vane can operate in a slightly corrosive atmosphere. Accordingly, it is presumed that the abnormal abrasion of the vane is attributed not only to mere abrasive type abrasion but also to a mechanism involving corrosion. In this case, molybdenum and cobalt besides chromium, are solid-dissolved in the base to exert an effect of enhancing the corrosion resistance of the vane and hence reducing the abrasion of the vane as mentioned below. If the content of chromium decreases less than 3% by weight, the foregoing effect is lowered. On the contrary, if the content of chromium exceeds 6% by weight, it makes difficult to provide a desired hardness by heat treatment. Accordingly, the content of chromium should be in the range of 3 to 6% by weight, preferably 3 to 5% by weight.

Tungsten and molybdenum are bonded to carbon to form an $M_6C$ type carbide that enhances the abrasion resistance and scoring resistance of the vane material. Tungsten and molybdenum are also partially solid-solutioned in the base material, and then deposited by tempering to exert an effect of enhancing the hardness of the vane material. Molybdenum also has an effect of inhibiting the corrosion by a carboxylic acid. Though W or Mo has the above effect even if the amount of W or Mo used is small, preferably (W+2Mo) is 24% by weight or more. If tungsten and/or molybdenum are used, in an amount of not more than 30% by weight and not more than 20% by weight, respectively, provided that (W+2Mo) exceeds 45% by weight, the toughness of the vane material is markedly lowered. Accordingly, (W+2Mo) should be not more than 45% by weight. The content of tungsten is preferably in the range of not more than 25% by weight, more preferably not more than 20% by weight. The content of molybdenum is preferably in the range of not more than 15% by weight, more preferably not more than 12% by weight.

Cobalt is solid-solutioned in the matrix to exert an effect of enhancing the hardness of the vane material. Cobalt also has a great effect of inhibiting the corrosion by a carboxylic acid as an important aspect of the present invention. In detail, as mentioned above, if substitutes of Freon gas (CFC) such as HFC is used as a cooling medium, it causes corrosive abrasion that involves abnormal abrasion of the vane. This abrasion can be reduced by solid-solutioned cobalt in the base material. However, if the content of cobalt exceeds 20% by weight, the toughness of the vane material is lowered. Accordingly, the content of cobalt should be not more than 20% by weight. In order to provide improvements in the hardness, corrosion resistance and abrasion resistance of the vane material as well as desired toughness, the content of cobalt is preferably in the range of 5 to 18% by weight, more preferably 8 to 15% by weight.

In the present invention, vanadium and/or niobium incorporated in the base material are bonded to carbon to form an MC type carbide. If this carbide is finely and homogeneously dispersed in the surface of the vane, it can provide drastic improvements in the abrasion resistance and scoring resistance along with the carbide particles sintered thereto. If the content of vanadium and/or niobium decreases less than 2% by weight, sufficient effect cannot be exerted. On the other hand, if the content of vanadium and/or niobium in the base material exceeds 10% by weight, it raises the oxygen content in the base powder, lowering the sinterability of the base material. Accordingly, the content of vanadium and/or niobium in the base material should be not more than 10% by weight. In order to provide improvements in the abrasion resistance, scoring resistance and sinterability at the same time, the content of vanadium and/or niobium is preferably in the range of 3 to 9% by weight.

The vane material thus obtained may be used untreated as a vane. It may be optionally subjected to surface treatment such as nitriding, ionic nitriding, boriding, oxidative nitriding and coating of hard film such as TiC and TiN by CVD or PVD before assembled in the compressor. This surface treatment has an effect of reducing the coefficient of friction of the vane with the rotor and hence eliminating scoring with its mating members as well as protecting the vane material against corrosive atmosphere.

The present invention will be further described in the following examples, but the present invention should not be construed as being limited thereto.

EXAMPLE 1

Three kinds of water-atomized powder A to C having the steel compositions as set forth in Table 1 were prepared. These powders were each mixed with carbide powder, nitride and/or carbonitride powder in the mixing ratio as shown in Table 2. These mixtures were each press-molded, and then sintered to prepare vane materials. Comparative Examples shown in Table 2 were vane materials prepared in the same manner as above except that no carbide powder was added in the materials.

TABLE 1

| | Chemical composition (wt. %) | | | | | | | | | | |
|---|---|---|---|---|---|---|---|---|---|---|---|
| Symbol | C | Si | Mn | Cr | W | Mo | V | Nb | Co | Fe | W + 2Mo |
| A | 3.0 | 0.3 | 0.3 | 4.0 | 12.8 | 10.5 | 6.7 | — | 10.5 | balance | 33.8 |
| B | 1.9 | 0.3 | 0.3 | 4.0 | 9.3 | 7.5 | 2.5 | 1.2 | 8.8 | balance | 24.3 |
| C | 2.8 | 0.3 | 0.3 | 4.0 | 7.1 | 4.8 | — | 8.9 | 10.2 | balance | 16.7 |

TABLE 2

| Specimen No. | Amount of atomized powder (wt. %) | Amount of dispersed additive particles (wt. %) | Remarks |
|---|---|---|---|
| 1 | Powder A: 89% | TiN: 8%; VC: 3% | Invention |
| 2 | Powder A: 89% | TiN: 11%; | Comparison |
| 3 | Powder A: 83% | TiN: 12%; VC: 5% | Invention |
| 4 | Powder A: 83% | TiN: 17%; | Comparison |
| 5 | Powder A: 76% | TiN: 12%; VC: 12% | Invention |
| 6 | Powder A: 76% | TiN: 24%; | Comparison |
| 7 | Powder B: 86% | TiCN: 9%; NbC: 5% | Invention |
| 8 | Powder B: 86% | TiCN: 14% | Comparison |
| 9 | Powder B: 83% | TaN: 7%; VN: 4%; TaC: 3%; ZrC: 3% | Invention |
| 10 | Powder B: 83% | TaN: 10%; VN: 7% | Comparison |
| 11 | Powder C: 82% | NbN: 5%; HfN: 6%; TiC: 3%; HfC: 4% | Invention |
| 12 | Powder C: 89% | NbN: 9%; HfN: 9% | Comparison |
| 13 | Powder C: 79% | TiN: 5%; ZrN: 6% VC: 4%; NbC: 6% | Invention |
| 14 | Powder C: 79% | TiN: 11%; ZrN: 10% | Comparison |

Vane Material Specimens 1 to 14 were evaluated for scuffing resistance in an atmosphere of cooling gas. For the evaluation of scuffing resistance, the vane material was pressed against JIS-FC250 with a contact area of 0.58 $cm^2$ while JIS-FC250 was being rotated at a circumferential velocity of 2 m/sec. During the measurement, the load on the vane material was increased at a rate of 0.3 kgf/sec. The point at which the friction coefficient shows a sudden rise was defined as scuffing point (i.e., seizuring point). The maximum allowable load under which no scuffing occurs and the maximum friction force by which no scuffing occurs were determined for evaluation. As the cooling medium there was used HFC type R134a. As the lubricant there was used an ester type lubricant. The results are shown in Table 3.

TABLE 3

| Specimen | Max. allowable load under which no scuffing occurs (kgf) | Max. allowable friction force by which no scuffing occurs (kgf) | Remarks |
|---|---|---|---|
| 1 | 410 | 10.8 | Invention |
| 2 | 310 | 7.9 | Comparison |
| 3 | 450 | 11.7 | Invention |
| 4 | 330 | 8.3 | Comparison |
| 5 | 460 | 12.1 | Invention |
| 6 | 360 | 9.1 | Comparison |
| 7 | 400 | 10.5 | Invention |
| 8 | 290 | 7.6 | Comparison |
| 9 | 440 | 11.4 | Invention |
| 10 | 320 | 8.0 | Comparison |
| 11 | 450 | 11.9 | Invention |
| 12 | 350 | 8.9 | Comparison |
| 13 | 430 | 11.2 | Invention |
| 14 | 320 | 8.3 | Comparison |

As is apparent from the results of Table 3, the vane materials obtained by composite addition of the carbide particle of the present invention to the nitride and/or carbonitride exhibit a higher maximum allowable load under which no scuffing occurs and a higher friction force by which no scuffing occurs as compared with the vane materials free of additive carbide of the present invention. This demonstrates that the present invention provides improvement of scuffing resistance under a high load required in an atmosphere of the substitutes of CFC Freon cooling medium.

EXAMPLE 2

The vane materials of Example 1 were evaluated for corrosion resistance with the substitutes of CFC Freon.

It is presumed that the Ester type lubricants for HFC Freon gas are decomposed to form formic acid and acetic acid. Therefore, the specimen was dipped in a mixture of 5% aqueous solution of formic acid and 5% aqueous solution of acetic acid at a temperature of 60° C. for 30 hours. Then, the resulting corrosion loss was determined to evaluate the corrosion resistance of the specimen. The results are shown in Table 4. The specimen number shown in Table 4 corresponds to that in Table 2.

As is apparent from the results of Table 4, the comparison of the examples of the present invention with the comparative examples using the same base material as the examples of the present invention shows that there is little or no difference in corrosion loss therebetween, showing no deterioration of corrosion resistance due to the addition of carbide. It can also be seen that Specimens 1 to 10, which comprised the base powder A or B having a high (W+2Mo) value, have a reduced corrosion loss and hence an excellent corrosion resistance, as compared with those of Specimens 11 to 14, which comprised a base powder having a low (W+2Mo) value.

TABLE 4

| Specimen | Corrosion loss ($mg/cm^2 \cdot h) \times 10^{-3}$ | Remarks |
|---|---|---|
| 1 | 5.8 | Invention |
| 2 | 5.7 | Comparison |
| 3 | 6.0 | Invention |
| 4 | 5.9 | Comparison |
| 5 | 6.3 | Invention |
| 6 | 6.4 | Comparison |
| 7 | 7.4 | Invention |
| 8 | 7.6 | Comparison |
| 9 | 7.2 | Invention |
| 10 | 7.3 | Comparison |
| 11 | 7.9 | Invention |
| 12 | 8.1 | Comparison |
| 13 | 8.0 | Invention |
| 14 | 7.8 | Comparison |

EXAMPLE 3

Specimens 1 to 14 shown in Table 2 were used to prepare vanes. These vanes were each mounted in a practical rotary compressor employing R134a as a cooling medium for the evaluation of life. As the rotor material there was used FCC25. The results of the life experiment are shown in Table 5. The specimen number shown in Table 5 corresponds to that in Table 2.

As is apparent from the results of Table 5, the vane material according to the present invention comprising a carbide particle sintered thereto can serve as vanes for practical compressors.

TABLE 5

| Specimen No. | Vane noze abrasion loss (μm) | Roller outer diameter abrasion loss (μm) | Vane side abrasion loss (μm) | Remarks |
|---|---|---|---|---|
| 1 | 1.0 | 0.9 | 0.2 | Invention |
| 2 | 1.4 | 5.0 | 1.1 | Comparison |
| 3 | 0.9 | 0.8 | 0.1 | Invention |
| 4 | 1.3 | 3.4 | 2.1 | Comparison |
| 5 | 0.9 | 0.9 | 0.1 | Invention |
| 6 | 1.4 | 6.2 | 1.8 | Comparison |
| 7 | 0.8 | 1.1 | 0.1 | Invention |
| 8 | 1.5 | 2.6 | 1.7 | Comparison |
| 9 | 0.9 | 0.6 | 0.1 | Invention |
| 10 | 1.3 | 2.8 | 1.2 | Comparison |
| 11 | 0.9 | 0.9 | 0.1 | Invention |
| 12 | 1.4 | 1.6 | 1.0 | Comparison |
| 13 | 0.8 | 0.8 | 0.1 | Invention |
| 14 | 1.5 | 7.2 | 1.3 | Comparison |

EXAMPLE 4

A water-atomized powder D having the steel composition shown in Table 6 was prepared. The water-atomized powder D was mixed with carbide powders and/or nitride powders in the mixing ratio shown in Table 7. The mixtures were each press-molded, and then sintered to prepare vane materials. As an additive carbide particle there was used VC. As an additive nitride and/or carbonitride particle there was used TiN. The vane materials thus obtained were then measured for maximum allowable load under which no scuffing occurs, maximum friction force by which no scuffing occurs, and product of load per contact area and circumferential velocity at the scuffing (baking) point (PV). The results are shown in Table 7.

TABLE 6

| Symbol | Chemical composition (wt. %) | | | | | | | | | | |
|---|---|---|---|---|---|---|---|---|---|---|---|
| | C | Si | Mn | Cr | W | Mo | V | Nb | Co | Fe | W + 2Mo |
| D | 2.8 | 0.3 | 0.3 | 4.0 | 15.2 | 11.2 | 5.6 | — | 10.3 | balance | 37.6 |

TABLE 7

| Specimen No. | Additive VC content (wt. %) | Additive TiN content (wt. %) | Max. allowable load under which no scuffing occurs (kgf) | Max. allowable friction force by which no scuffing occurs (kgf) | PV value (kgf/cm$^2$ · m/S) | Remarks |
|---|---|---|---|---|---|---|
| 15 | 0 | 15 | 330 | 8.3 | 690 | Comparison |
| 16 | 1 | 15 | 380 | 9.8 | 810 | Invention |
| 17 | 5 | 15 | 430 | 10.4 | 930 | Invention |
| 18 | 10 | 15 | 440 | 11.2 | 950 | Invention |
| 19 | 20 | 15 | 410 | 10.2 | 870 | Invention |
| 20 | 25 | 15 | 420 | 11.0 | 900 | Invention |
| 21 | 30 | 15 | 340 | 9.1 | 730 | Comparison |
| 22 | 8 | 0 | 300 | 7.4 | 580 | Comparison |
| 23 | 8 | 1 | 330 | 8.2 | 700 | Comparison |
| 24 | 8 | 2 | 420 | 11.0 | 900 | Invention |
| 25 | 8 | 10 | 450 | 11.5 | 970 | Invention |
| 26 | 8 | 20 | 430 | 11.2 | 920 | Invention |
| 27 | 8 | 25 | 390 | 9.9 | 840 | Invention |
| 28 | 8 | 30 | 320 | 7.9 | 670 | Comparison |

As is apparent from the results of Example 4, the specimens comprising a carbide particle in the amount defined herein, i.e., more than 0% to not more than 25% by weight based on the total weight of the vane and a nitride particle in the amount defined herein, i.e., 2 to 25% by weight based on the total weight of the vane exhibit a high maximum allowable load under which no scuffing occurs, a high maximum allowable friction force by which no scuffing occurs and a high PV value. This demonstrates that the composite addition of an additive carbide and an additive nitride provides a high scuffing resistance as compared with the addition of a nitride alone.

In accordance with the present invention, the scuffing resistance of the vane can be drastically improved in a compressor employing the substitutes of CFC Freon gas such as HFC Freon as a cooling medium. Further, the vane material according to the present invention exhibits a sufficient corrosion resistance against a carboxylic acid such as formic acid and acetic acid produced by the decomposition of a lubricant in a compressor employing HFC Freon gas. Accordingly, the vane material according to the present invention is extremely suitable for the use with a new cooling medium such as HFC Freon, making it possible to realize a compressor that can meet the recent environmental regulations.

While the invention has been described in detail and with reference to specific embodiments thereof, it will be apparent to one skilled in the art that various changes and modifications can be made therein without departing from the spirit and scope thereof.

What is claimed is:

1. A vane material having a structure which is obtained by sintering a composition comprising a base material consisting essentially of 1.0 to 4.5% by weight of carbon, not more than 1.5% by weight of silicon, not more than 1.0% by weight of manganese, 3 to 6% by weight of chromium, not more than 30% of tungsten and/or not more than 20% by weight of molybdenum provided that (W+2Mo) is not more than 45% by weight, 2 to 10% by weight of vanadium and/or niobium, not more than 20% by weight of cobalt, and a balance of iron and inavoidable impurities; additive particles of a carbide in an amount of 1% to not more than 25% by weight based on the total weight of the composition; and additive particles of a nitride and/or carbonitride in an amount of 2 to 25% by weight based on the total weight of the composition, the total weight of carbide, nitride and carbonitride particles being 14% by weight or more.

2. The vane material as in claim 1, wherein said additive particles of carbide are contained in the composition in an amount of 1 to 20% by weight based on the total weight of the composition.

3. The vane material as in claim 1, wherein said additive particles of nitride or carbonitride are contained in the composition in an amount of 3 to 20% by weight based on the total weight of the composition.

4. The vane material as in claim 1, wherein said carbide is a compound of vanadium or niobium.

5. The vane material as in claim 1, wherein said nitride or carbonitride is a compound of at least one selected from the group consisting of titanium, zirconium, hafnium, vanadium, niobium and tantalum.

6. A process for preparing a vane material which comprises:

mixing a base powder consisting essentially of 1.0 to 4.5% by weight of carbon, not more than 1.5% by weight of silicon, not more than 1.0% by weight of manganese, 3 to 6% by weight of chromium, not more than 30% of tungsten and/or not more than 20% by weight of molybdenum provided that (W+2Mo) is not more than 45% by weight, not more than 20% by weight of cobalt, and a balance of iron and inavoidable impurities; mixing powders of a carbide and powders of a nitride and/or carbonitride in an amount of 1% to not more than 25% by weight and 2 to 25% by weight based on the total weight of the vane material, respectively, and then with the mixed base powder, the total weight of carbide, nitride and carbonitride being 14% by weight or more; and then sintering.

* * * * *